United States Patent [19]

Angelini

[11] Patent Number: 4,820,395

[45] Date of Patent: Apr. 11, 1989

[54] CELL FOR CONTINUOUS ELECTROLYTIC DEPOSITION TREATMENT OF BARS AND THE LIKE

[76] Inventor: Sergio Angelini, Residenza del Cantone 61, Segrate (Milan), Italy

[21] Appl. No.: 96,054

[22] Filed: Sep. 11, 1987

[30] Foreign Application Priority Data

Sep. 12, 1986 [IT] Italy ..... 21686 A/86

[51] Int. Cl.[4] ..... C25D 17/00

[52] U.S. Cl. ..... 204/207

[58] Field of Search ..... 204/207

[56] References Cited

U.S. PATENT DOCUMENTS 3,751,344 8/1973 Angelini ..... 204/207

3,852,170 12/1974 Angelini ..... 204/207

*Primary Examiner*—T. M. Tufariello

*Attorney, Agent, or Firm*—Herbert Dubno; Ronald Lianides

[57] ABSTRACT

The cell for continuous electrolytic deposition treatment of bars or the like according to the invention comprises a closed vessel containing at least one tubular anode through which a bar for electrolytic processing can be conveyed in the axial direction, the bar being inserted into the vessel and leaving the vessel through respective inlet and outlet mouthpieces equipped with sealing means, means being present for supplying a flow of electrolytic bath to the anode or anodes and transferring the bath from the anode to the vessel, producing a flow of the bath inside the anode and parallel to the bar to be processed, dielectric spacing means also being present between the bar inlet mouthpiece and the end of the adjacent anode and adapted to define a zone of controlled chemical attack before electroplating begins.

12 Claims, 7 Drawing Sheets

CELL FOR CONTINUOUS ELECTROLYTIC DEPOSITION TREATMENT OF BARS AND THE LIKE

FIELD OF THE INVENTION

The invention relates to a cell for continuous electrolytic deposition treatment of bars or the like, more particularly for chromium-plating, the treatment bath flowing parallel to the bars to be treated.

BACKGROUND OF THE INVENTION

In many applications it is necessary to use metal components having a metal surface coating giving special properties such as resistance to corrosion, surface hardness, resistance to abrasion or the like.

One example of such treatment is chromium-plating, which is carried out on some moving mechanical components such as actuator shafts or rods, runners or slides or the like, since these components need high surface mechanical strength or resistance to corrosion in the operating environment.

In methods of electroplating used for this purpose, a layer of electroplated material is deposited on the metal surface to be treated, the layer being supplied in the form of positive ions in an electrolytic bath in which the metal component to be coated forms the cathode, a voltage being applied so as to cause the required current to flow.

In order to carry out this operation continuously, more particularly on rectilinear bars and the like, there are some known cells in which each bar is inserted through a mouthpiece fitted with sealing means and is immersed in the electroplating bath and travels inside one or more tubular anodes having perforated surfaces and likewise immersed in the bath.

These cells, however, present some problems in that when the bar is in direct contact with the bath, a stationary layer of bath forms during treatment, in which the concentration of the metal ion to be deposited is lower than the optimum value and thus slows down the deposition process. Also, interfering reactions occur in the electrolytic bath and form gas, more particularly hydrogen, at the cathode surface.

In order to remove the gas, the anode is given a perforated surface, but hydrogen bubbles collect on the cathode surface and thus separate it from the bath and impede chemical deposition in these areas, resulting in irregularities and defects in the deposited layer, e.g. porosity or reduced compactness, thus reducing the chemical and mechanical strength imparted by the treatment.

This process also limits the maximum density of the current which can be applied to the cell, and consequently limits the speed of electroplating since, above a certain limit, an increase in current results in a substantial increase in side-reactions without increasing the deposition of metal on the cathode, owing to the limited exchange of intermediate chemical species inside the cathode film.

Another requirement is that the surface of the bar to be processed must be activated in order to increase the efficiency of electroplating. Activation is advantageously brought about by chemical means, with a controlled attack in the electroplating bath, but there is then the problem of providing a zone in the electroplating cell where the electrochemical potentials enable chemical action to occur to the desired extent.

In known cells, there is also the problem of ensuring a good seal around the bar moving across the cells, to avoid losses or escapes of the bath to the exterior, and also of adapting the seals to differences in dimensions between successively introduced bars, so that for example bars of different dimensions can be treated in succession without interruptions through replacing the sealing means between groups of bars of different dimensions.

OBJECTS OF THE INVENTION

The object, therefore, are to provide an electroplating cell ensuring adequate renewal of solution in contact with the cathode, removal of any gas formed, deposition of thick compact layers in reduced times, controlled chemical attack for activating the surface of the bar before electrodeposition, and prevention of gases or liquids from escaping to the exterior during the process and thus possibly causing environmental pollution.

SUMMARY OF THE INVENTION

These objects are obtained by the invention, which provides a cell for continuous electrolytic deposition treatment of bars or the like, comprising a closed vessel containing at least one tubular anode through which a bar for electrolytic processing can be conveyed in the axial direction, the bar being inserted into the vessel and leaving the vessel through respective inlet and outlet mouthpieces equipped with sealing means, means being present for supplying a flow of electrolytic bath to the anode or anodes and transferring the bath from the anode to the vessel, thus producing a flow of the bath inside the anode and parallel to the bar to be processed, dielectric spacing means also being present between the bar inlet mouthpiece and the end of the adjacent anode and adapted to define a zone of controlled chemical attack before electroplating begins.

In greater detail, the inlet and outlet mouthpieces each comprise a cylindrical body connected in a sealing-tight manner to the outer vessel and formed with an axial orifice for conveying the bars to be processed, with hydraulic sealing means therein engaging the bar, a duct opening into the cylindrical body so as to supply a flow of electrolytic treatment bath delivered by a pump drawing from the outer vessel, the supply duct terminating inside the mouthpiece body in an intake chamber bounded by a collar surrounding the bar travelling through the mouthpiece, the intake chamber having an annular outflow opening between the end of the collar and the mouthpiece body and through which the bath is supplied parallel to the bar inside the tubular anode, which is directly connected to the mouthpiece body, and if required with interposition of a spacing member of dielectric material in the inlet mouthpiece.

The inlet and outlet mouthpieces are provided with hydraulic sealing means comprising a number of flat annular seals of radially deformable material surrounding the bar for treatment in the cell and maintaining sealing-tightness around it, the seals being disposed in rows between which they define a number of annular chambers around the bar, the chamber being formed with discharge openings for the liquid present inside the vessel.

Advantageously, the inlet and outlet mouthpieces have reduced-diameter passageways which connect the interior of the anode or anodes to the chambers bounded by the seals around the bar and are adapted to supply the chambers with a sufficient flow of liquid to lubricate the seals and prevent direct contact between them and the surface of the bar.

The annular outflow aperture from the intake chamber has a cross-section such as to accelerate the flow of treatment bath by producing a negative pressure by the "Venturi" effect in the intake chamber acting towards the hydraulic sealing means engaging the bar.

In a preferred embodiment, the cell according to the invention comprises a closed outer vessel containing an inner vessel housing at least one tubular anode through which a bar for electrolytic treatment can travel in the axial direction, the bar being inserted into the vessels and discharged therefrom through respective inlet and outlet mouthpieces comprising sealing means, means being present for supplying a flow of electrolytic bath to the inner vessel and transferring the bath therefrom to the outer vessel, thus producing a flow of bath inside the anode or anodes parallel to the bar to be treated.

Advantageously in this embodiment, the inner vessel is shaped as an axially horizontal cylinder, coaxial with the anode or anodes and open at the top, the bath therein being adapted to flow from the top thereof by falling into the outer vessel.

In a different embodiment of the invention, the inlet and outlet mouthpieces for the bar are directly connected in a sealing-tight manner to a tubular anode extending through the entire length of the cell and suspended above the free surface of the liquid permanently remaining in the vessel in which the anode is mounted, an aperture being formed in the central position of the anode at the top thereof so that the bath introduced therein through the mouthpieces can flow out by falling, and the bath can fall into the vessel.

In another alternative embodiment of the invention, the means for introducing a flow of electrolytic bath into the inner vessel and transferring the bath therefrom to the outer vessel, thus producing a flow of the bath in the anode or anodes parallel to the bar to be treated, comprises a single duct supplying the chromium-plating bath to two facing tubular anodes having their ends freely opening into the inner vessel near the inlet and outlet mouthpieces, the bars for treatment travelling axially through the anodes and the electrolytic bath travelling through them parallel to the bars, a space being left between the mouthpieces and the facing ends of the anodes so that the bath can flow freely into the vessel and leave a zone of controlled chemical attack near the inlet mouthpiece.

In another embodiment, the means for supplying a flow of electrolyic bath to the inner vessel and transferring the bath therefrom to the outer vessel, thus producing a flow of the bath between the anode or anodes parallel to the bar to be treated, comprises a duct supplying the chromium-plating bath to the inner vessel and forming a head of liquid therein, and outlet ducts extending towards the outer vessel from the inlet and the outlet mouthpiece respectively, the ducts being connected to two aligned tubular anodes through which the bar for treatment travels, the anodes being separated by an amount sufficient for a flow of electrochemical treatment bath to enter them, orifices being present for discharging the gases evolved in the top part of the mouthpieces.

In all the preceding embodiments, the outer vessel is connected in sealing-tight manner to a closed top chamber comprising vapor-sucking ducts connected to a plant for extracting and recycling the condensate to the vessel.

Also, the outer vessel and the top chamber are constructed with a metal outer wall and an inner lining of plastic such as polyvinyl chloride resistant to the chemical agents in the chromium-plating bath, the outer vessel being without orifices, outlets or the like forming discontinuities in the plastic coating, the level of the liquid in the outer vessel being kept below the level of the junction between the vessel and the top chamber.

BRIEF DESCRIPTION OF THE DRAWING

The above and other objects will become more clear from the following description of a chromium-plating cell according to the invention, illustrated by way of example with reference to the accompanying drawings in which.

SPECIFIC DESCRIPTION

Figure 1:
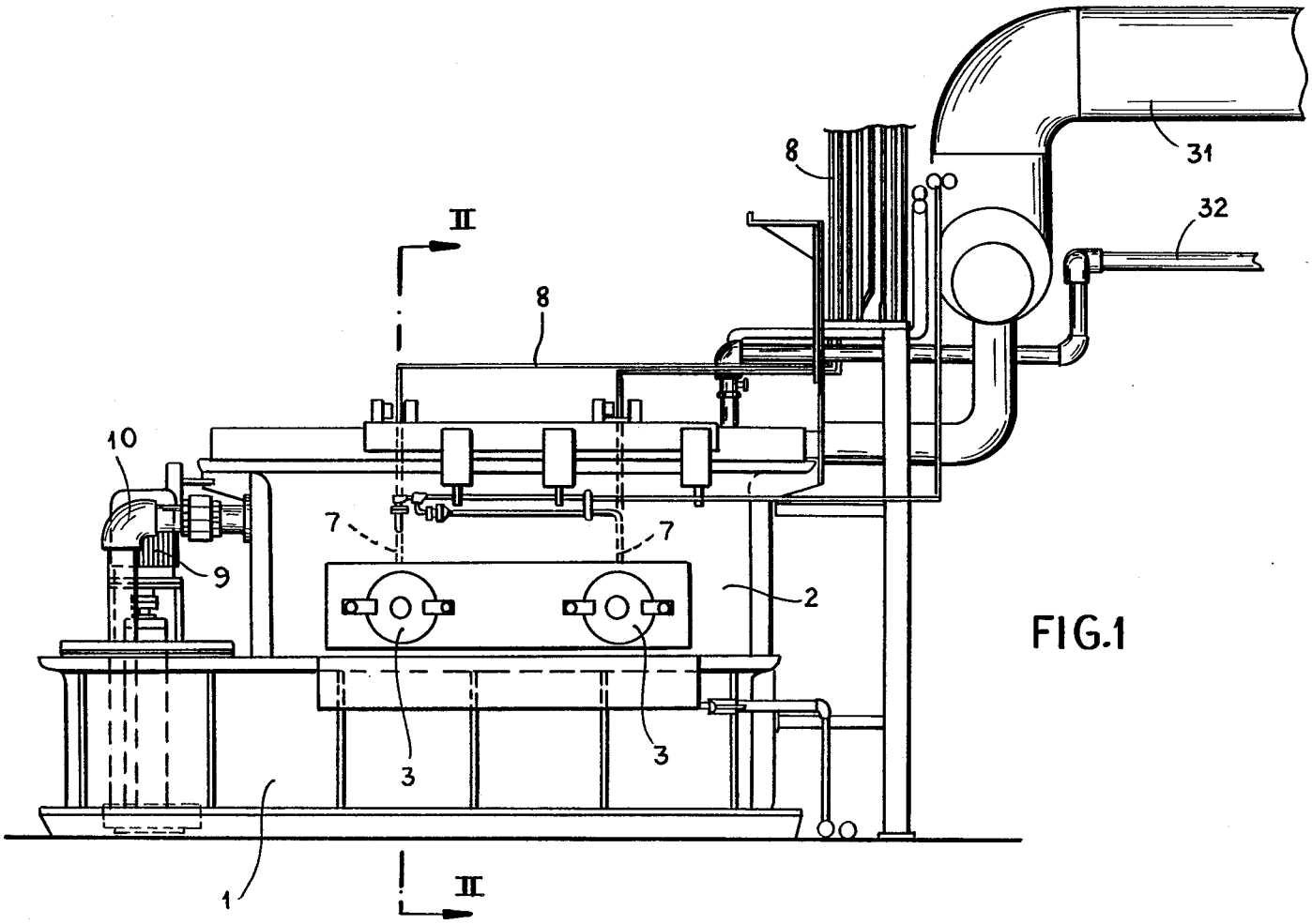
FIG. 1 is a general front view of the cell according to the invention.
Figure 2:
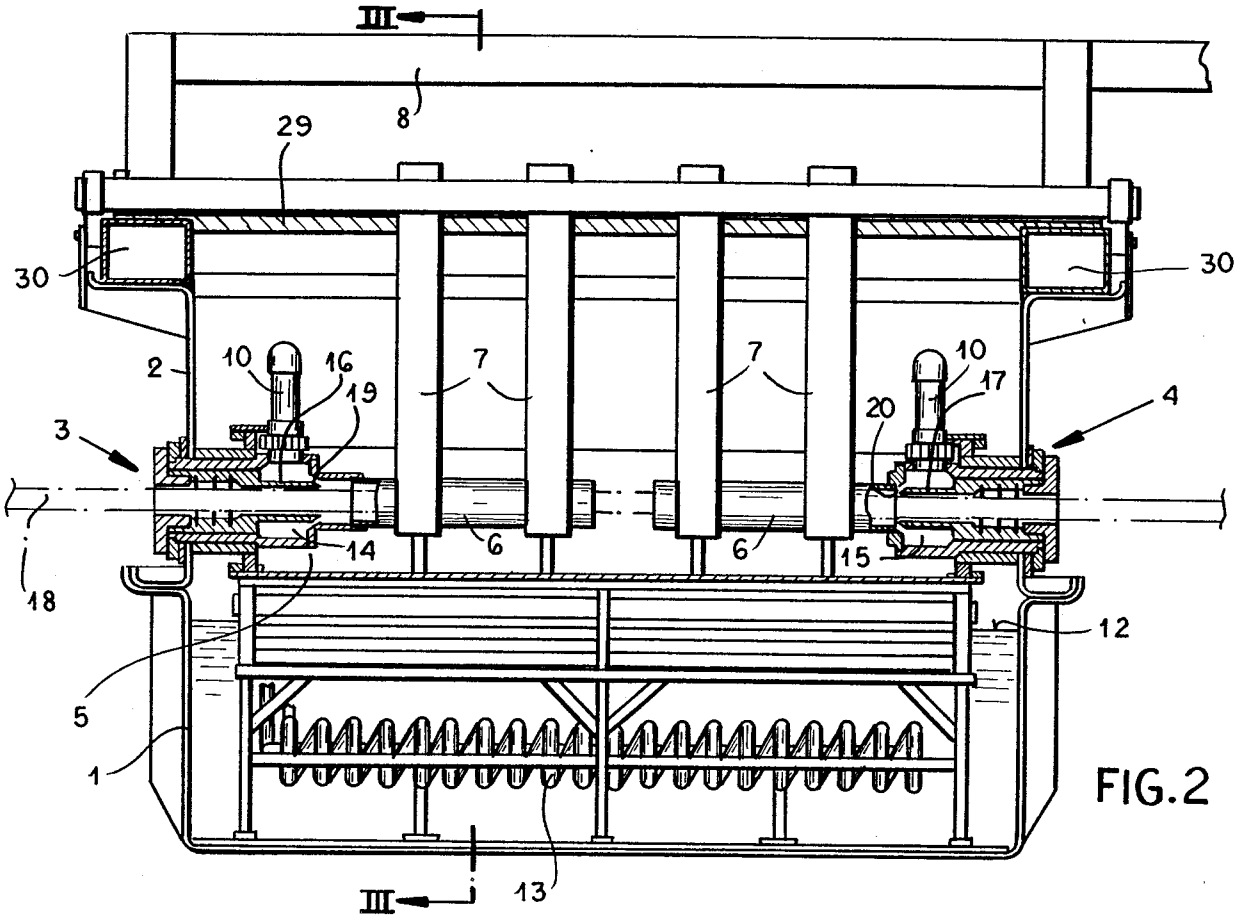
FIG. 2 is a cross-section of the cell in plane II—II in FIG. 1.

FIGS. 1 and 2 show a chromium-plating cell comprising a bottom vessel 1 on which a top chamber 2 is mounted and has one or more mouthpieces 3 for inserting bars for chromium-plating and corresponding mouthpieces 4 for discharging the bars.

Figure 3:
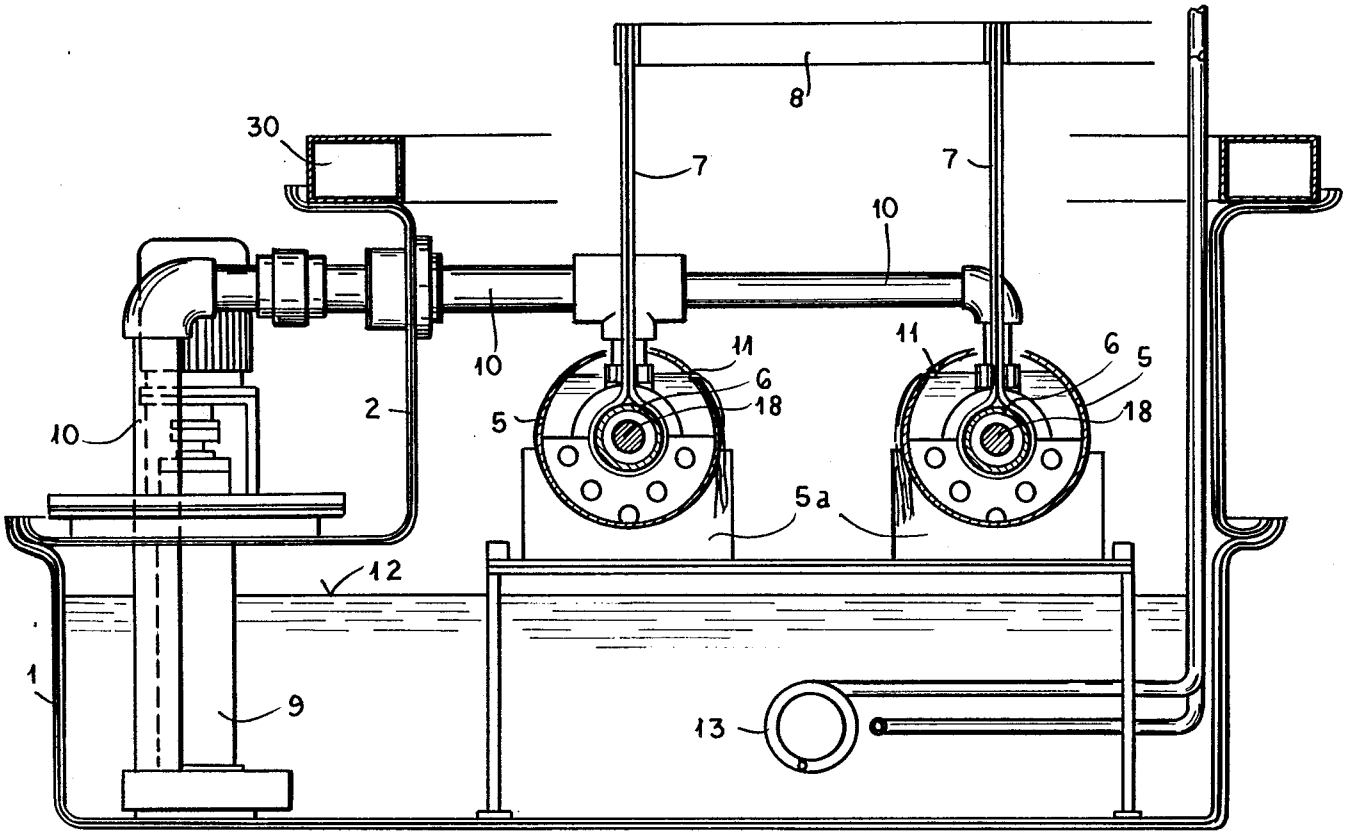
FIG. 3 is a section along piane III—III in FIG. 2 drawn to an enlarged scale.

Each pair of mouthpieces 3, 4 is connected in a sealing-tight manner to an inner vessel 5 in the shape of an axially horizontal cylinder open at the top as shown more clearly in section in FIG. 3, and supported by a bearing frame **5*a* and containing one or more tubular anodes 6 connected by busbars 7 to electric supply conductors 8 ending at the positive terminal of a current rectifier whose negative terminal is connected to the bar or bars for chromium-plating via suitable contact devices outside the cell, one anode 6 being associated with each mouthpiece 3 or 4**.

The inner vessels 5 are supplied with the chromium-plating bath by one or more pumps 9 and associated delivery tubes 10 which open into the inlet and outlet mouthpieces 3, 4 and draw the bath from the bottom of vessel 1, into which the bath drops from a return outlet 11 of vessels 5 so that the liquid in vessel 1 is kept at the level shown by line 12 in the drawings.

A coil 13 for heating and controlling the temperature of the bath is disposed at the bottom of vessel 1.

Figure 4:
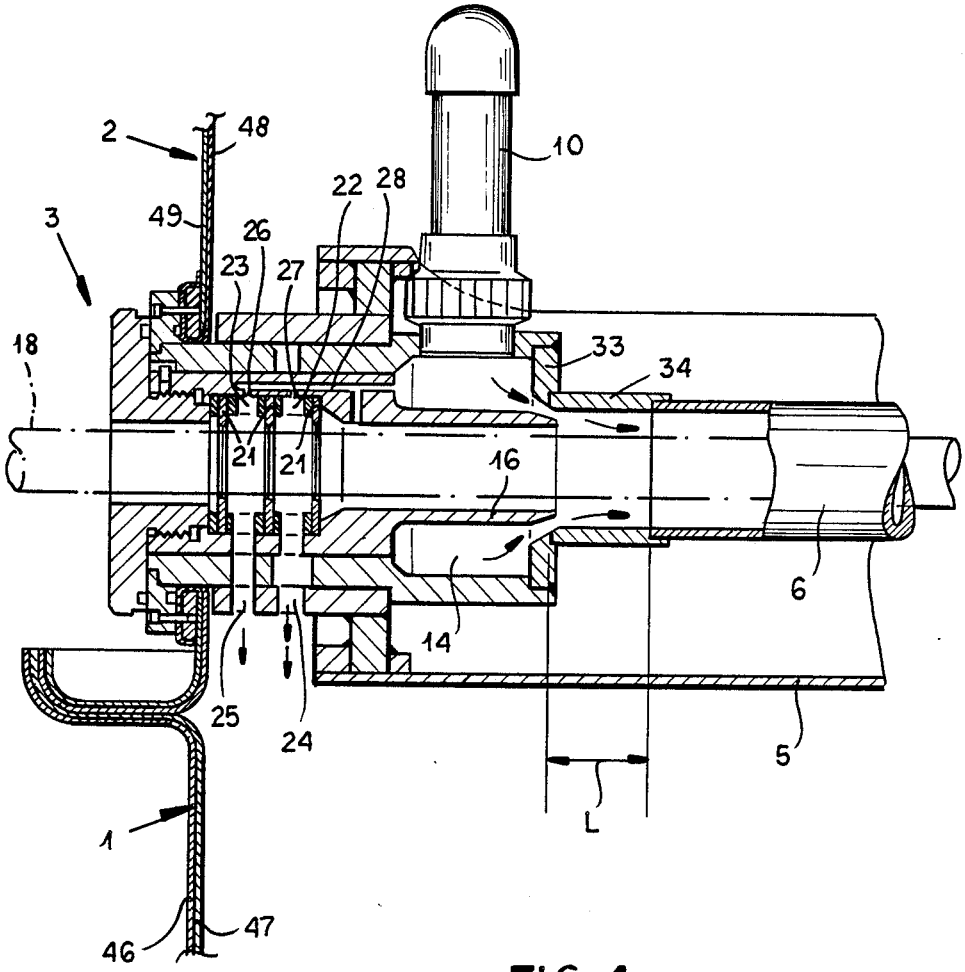
FIG. 4 is an enlarged detail of the inlet mouthpiece zone where the bar enters the cell.

As shown in FIG. 2 and in greater detail in FIG. 4, the tubes 10 for delivering the chromium-plating bath open into mouthpieces 3, 4 supplying respective annular intake chambers 14, 15 surrounding metal tubes 16, 17, through which a bar 18 travels for chromium-plating as shown by a dash-dotted line in the drawings. The chromium-plating bath then leaves chambers 14,15 and travels via conveying areas 19, 20 to the interior of tubular anodes 6 and flows between them and the bar advancing inside them without escaping to the exterior of the anodes, until the bath flows out at the free ends of the anodes.

The portion of tubes 16, 17 facing the exterior contains flat annular seals 21 of deformable elastomeric material adapted to fit to the diameter and provide a seal on bars having diameters within a certain range, e.g. 30 to 40 mm, so that bars of different diameters within this range can be processed without the metal tubes and associated seals having to be replaced each time.

When the bath is supplied through the conveying zone 19, 20 the flow of bath is accelerated in these zones and produces a "Venturi"-effect negative pressure behind these zones in the direction of flow and along bar 18, thus improving the tightness of seals 21.

Advantageously the seals are three in number for each metal tube, as shown in detail in FIG. 4, and together bound two annular chambers 22, 23 around bar 18 and provided at the bottom with associated discharge ducts 24, 25 so that the fraction of the bath which penetrates into chambers 22, 23 after passing through the inner seals falls through outlet 24, 25 into vessel 1 without losses through the outer seal.

Chambers 22, 23 are also supplied via passageways 26, 27, 28 communicating with chambers 14, 15 and with the interior of tubes 16, 17 and adapted to supply a very small quantity of bath, determined by the small diameter of the passageway themselves, to chambers 22, 23 for the purpose of lubricating the seals 21 and avoiding direct contact between their material and the bar to be chromium plated, since such contact could result in surface soiling of the bar and an irregular deposit of chromium on the bar.

The cell is closed at the top by a cover plate 29 and its top edge is surrounded by a collecting suction duct 30 communicating with the cell interior and connected to a condult tube 31 leading to a the plant for the extraction of emitted gases.

The fractions of bath which condense and are extracted in these plants are then returned to the cell through pipe 32, thus eliminating emission of polluting effluents to the exterior.

The chromium-plating bath flows parallel to the motion of the bar 18 along the channel inside the tubular anode 6. This has the advantage of high turbulence at the surfaces of the bar and anode, so that the electrolytic solution in these areas is rapidly renewed, increasing the rate of chromium deposition and enabling the current density to be increased.

The flow of bath along the bar 18 serves the further purpose of cleaning the bar surface from bubbles of hydrogen gas which may be formed through the side-reaction of dissociation of water in the bath solution. The gases are conveyed beyond the anode without preventing good contact between the bath and the surface of the bar, which would result in irregularities in the layer of deposited compactness.

Since bubbles are mechanically removed and conveyed beyond the end portion of the anode, there is no need for anodes in a tube having a perforated surface as in some known cells, and consequently the gas can be removed when formed and the area of anode can be increased without increasing the dimensions.

With regard to the mouthpiece 3 for inserting the bar into the cell, a tubular spacer member 34 is disposed between the mouthpiece body 33 and the tubular anode 6. Member 34, which is made of insulating material like the other parts of the cell, has a length "L" sufficient for maintaining a distance between the zone where the bar makes initial contact with the chromium-plating bath and the place where the anode begins.

In this zone, the bath chemically attacks the bar surface and removes any layer of surface oxide so that the surface is activated for deposition, thus substantially improving the adhesion between the deposited chromium layer and the underlying metal.

The length "L" of member 34 depends on the dimensional and operating characteristics of the cell.

For example, in a chromium-plating cell where the speed of the bath in contact with the bar to be chromium-plated was 1.5 m/s and the current density was 150 $A/dm^2$ at a temperature of 70° C., the length "L" was advantageously between 80 and 150 mm and preferably equal to 100 mm.

Under these conditions, using a chromium-plating bath containing 300 g/l $CrO_3$ and 3.5 g/l of $H_2SO_4$ without a catalyst, the electrochemical deposition yield was 26 to 27%, substantially higher than that obtainable with conventional cells.

Figure 5:
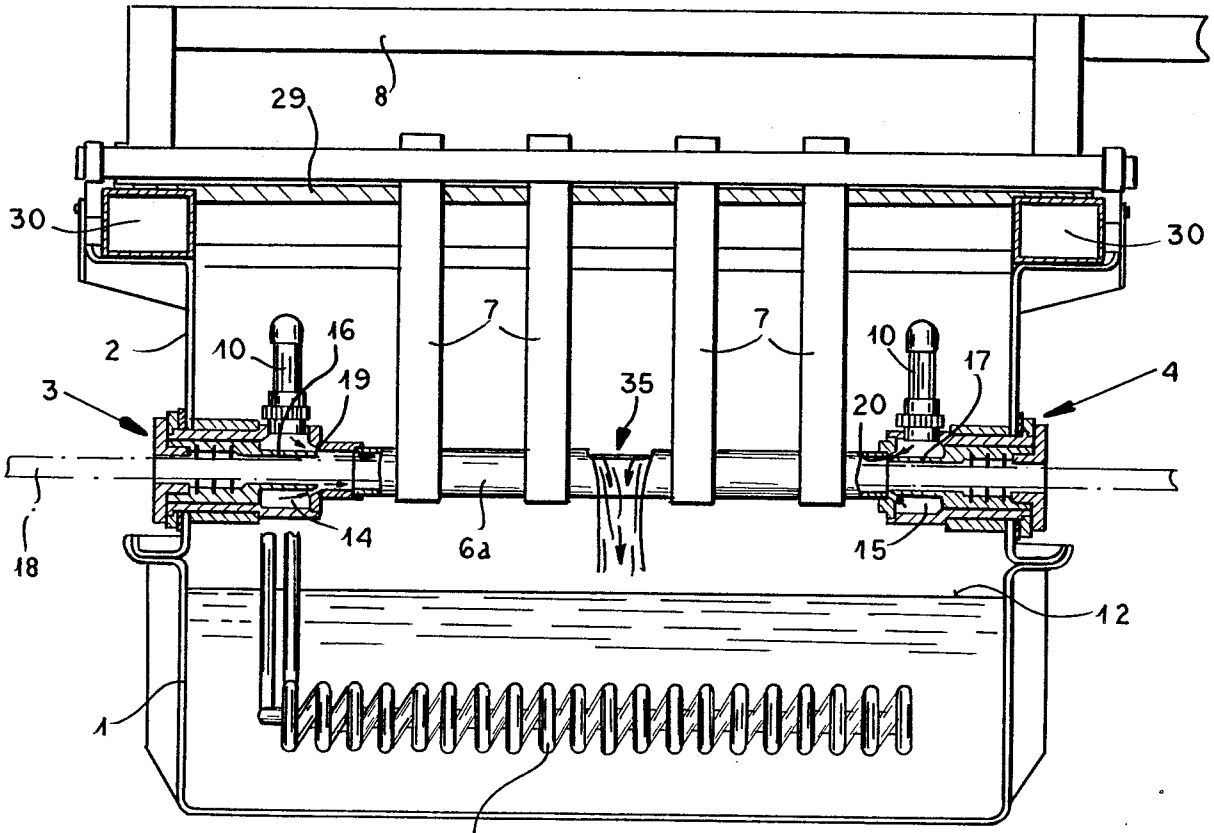
FIG. 5 is an alternative embodiment of the cell.

As FIG. 5 shows, the inner vessel 5 and associated bearing frame **5*a* can be eliminated by disposing a long anode 6*a* between mouthpieces 3 and 4 and connected in sealing-tight manner thereto, the chromium-plating bath being supplied inside the anode and coming out through an aperture 35 in the central area of the anode in its top part, the bath falling directly into the outer vessel 1**.

Figure 6:
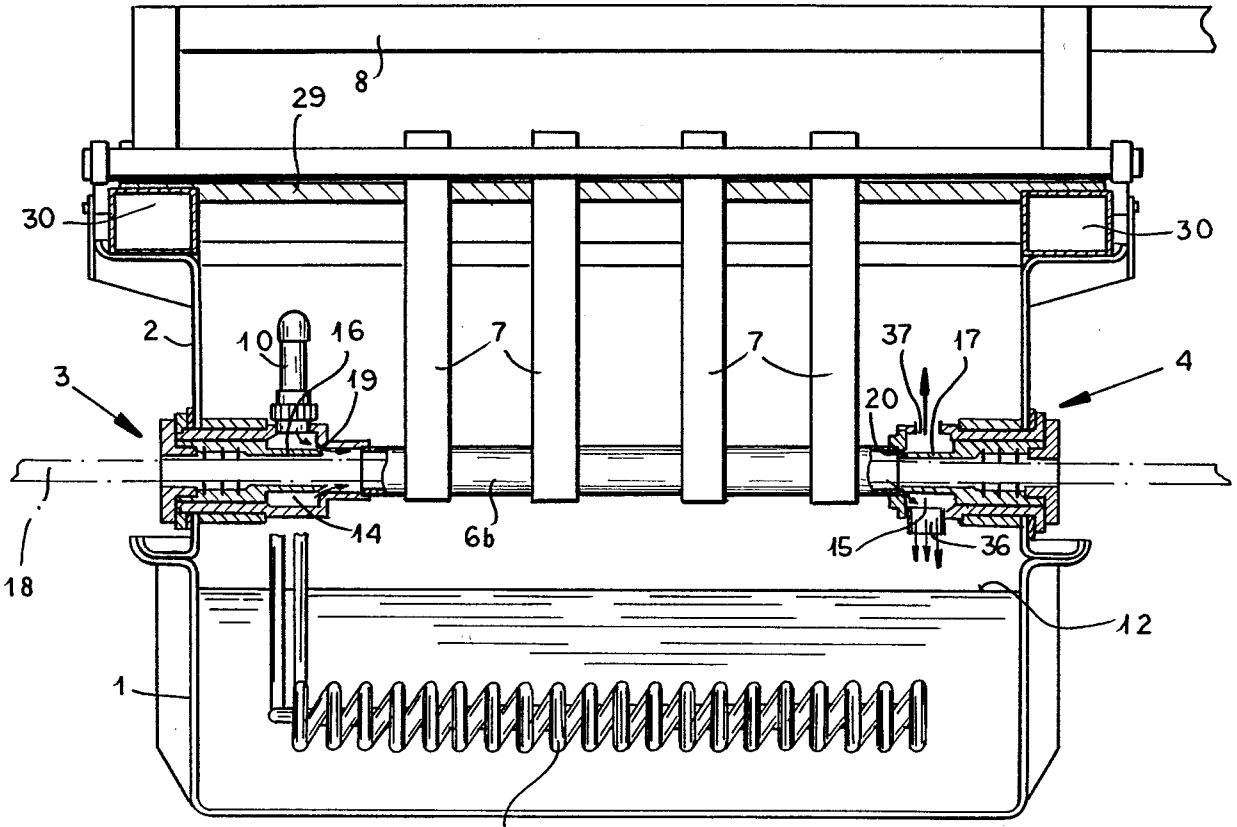
FIG. 6 is a second alternative embodiment of the cell.

FIG. 6 shows another possible embodiment in which the outlet mouthpiece 4 has a discharge mouth 36 whereas the anode **6*b* does not have other apertures. Accordingly, mouthpiece 3 is used for supplying the bath to the anode whereas mouthpiece 4 is used for supplying the bath to the outer vessel 1**.

The outlet mouth 36 can be disposed in the top part of mouthpiece 4 so that the bath can escape by falling and entrain the hydrogen formed. Alternatively, as illustrated, mouth 36 can be disposed at the bottom of the mouthpiece, in which case an additional aperture 37 will be needed at the top of the mouthpiece for discharging the hydrogen, as indicated by the arrow in the drawing.

Figure 7:
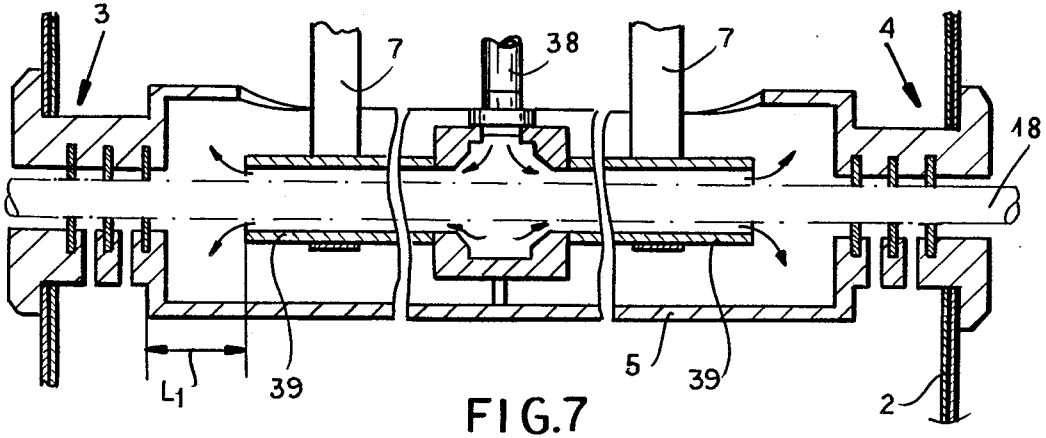
FIG. 7 is an alternative embodiment of the device for supplying the chromium-plating bath to the cell.

FIG. 7 shows another alternative embodiment of the invention comprising a single central delivery tube 38 for supplying the chromium-plating bath to the interior of anodes 39, through which the bath flows in opposite directions to their ends and out into the inner vessel 5, after which it falls into vessel 1.

In this embodiment there is no need to dispose a member 34 between the inlet mouthpiece and the anode 36, although a free distance "$L_1$" is still provided between the body of the mouthpiece and the end of the anode facing it, so that the bath can flow out of the anode into the vessel 5.

Figure 8:
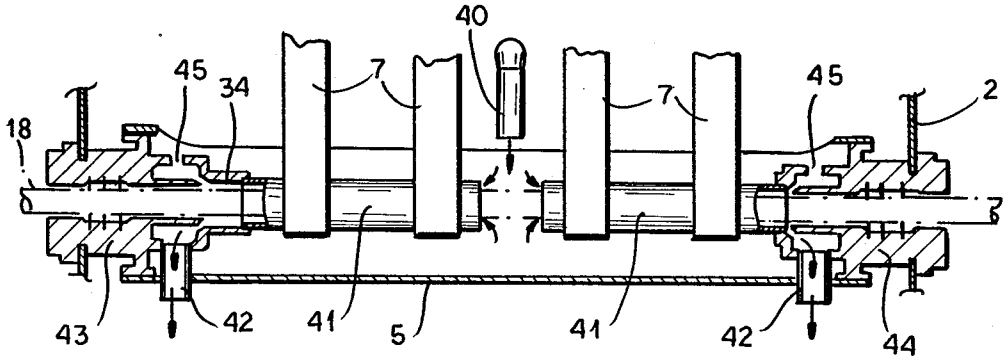
FIG. 8 is another alternative embodiment of the device for supplying the chromium-plating bath to the cell.

FIG. 8 shows another alternative embodiment of the cell according to the invention, comprising a delivery tube 40 for supplying a chromium-plating bath directly into vessel 5 and outside the anodes 41. The bath is discharged from vessel 5 via ducts 42 extending from the inlet and outlet mouthpieces 43, 44 and connected to the anodes 41. In this manner, as shown by arrows in the drawing, the head of liquid in the vessel causes the bath to flow through the anodes and out of ducts 42, thus making contact with the bar 18 to be chromium-plated and moving in the anodes, the flow being equivalent to that produced by two separate supplies through mouthpieces 3, 4 in FIG. 2 and FIG. 5.

In order to remove hydrogen by analogy with the preceding example, upwardly facing apertures 45 are formed in mouthpieces 43 and 44.

In the embodiments described hereinbefore with reference to FIGS. 7 and 8, the flow obtained along the bar to be chromium-plated has similar characteristics to the flow produced in the cell in FIGS. 2, 4 and 5. Owing to the lack of a "Venturi"-effect negative pressure at seals 21 there is a greater hydrostatic load on the seals, and to some extent also in the embodiment in FIG. 6, but this is offset in such applications by greater simplicity in the construction of the cell or other particular constructional or operating requirements.

The bottom vessel 1, like the top chamber 2, has an outwardly facing wall 46 made of metal, e.g. steel or the like, and having an internal lining 47 of a plastics such as polyvinyl chloride. Vessel 1 is made in one piece without apertures, outlets or other surface irregularities, so that it can be lined with plastics without junctions, welds or the like. Such irregularities could result in infiltration of the chromium-plating bath, the level of which would towards the metal wall 46, causing corrosion thereof.

The outlets and connections for the required ducts and conductors, such as the apertures for mouthpieces 3 and 4, are formed in the walls of the top chamber 2. In this chamber, vapors emitted by the bath in the presence of nascent oxygen may result in infiltration of condensed liquid between the metal wall of the vessel and the internal lining of plastics, the liquid penetrating through the previously-mentioned discontinuities into the lining and possibly causing initial corrosion. These processes, however, are limited to the top chamber, which is easier to check and maintain, and any infiltrations of condensed liquid have no effect on vessel 1 since it contains a head of liquid, and therefore cannot cause losses outside the bath or detachment of the lining from the vessel.

The chromium-plating cell according to the invention can be used to coat bars with metallic chromium, the coatings having considerably better hardness and chemical resistance to corrosion than coatings obtained in conventional cells. The production rate is higher owing to the greater permitted current density, and a number of cells can be connected in series to obtain particularly thick coatings.

Numerous variants can be introduced without departing from the scope of the invention and its general features.

I claim:

1. A cell for continuous electrolytic deposition treatment of bars, said cell comprising:

a closed outer vessel;

at least one tubular anode provided in said outer vessel through which a bar to be electrolytically processed can be conveyed in an axial direction;

respective inlet and outlet mouthpieces each provided with sealing means and each mounted on said outer vessel in alignment with said tubular anode so that said bar can be inserted into said outer vessel through said inlet mouthpiece and withdrawn from said outer vessel through said outlet mouthpiece;

means for supplying a flow of an electrolytic bath to said anode and transferring said electrolytic bath from said anode to said outer vessel, whereby said bath flows in said anode parallel to said bar; and dielectric spacing means between said inlet mouthpiece and a proximal end of said anode and adapted to provide a zone of controlled chemical attack on said bar prior to electrolytic deposition thereon.

2. The cell defined in claim 1 wherein said inlet and outlet mouthpieces each comprise a cylindrical body forming a seal with said outer vessel, said cylindrical body formed with an axial orifice for conveying the bars to be processed, said orifice being provided with means for forming a hydraulic seal with said bar, a pump disposed in said outer vessel and having a delivery tube opening into said cylindrical body for supplying a flow of electrolytic bath thereto from said outer vessel, said delivery tube terminating in an annular intake chamber formed in said cylindrical body and bounded by a collar which surrounds said bar being conveyed through said mouthpiece, said intake chamber having an annular outflow opening formed between an end of said collar and said cylindrical body and through which said electrolytic bath is supplied to flow parallel to said bar in said anode, said anode being connected to said cylindrical body.

3. The cell defined in claim 2 wherein said annular outflow opening has a cross-section whereby the flow of electrolytic bath therethrough is accelerated, producing a negative pressure by the Venturi effect in said intake chamber and acting towards said hydraulic sealing means in said orifice.

4. The cell defined in claim 1 wherein said inlet and outlet mouthpieces are provided with hydraulic sealing means comprising a plurality of flat annular seals of radially deformable material surrounding said bar and in contact therewith, said seals being disposed in rows between which define a plurality of second chambers surrounding said bar, each second chamber being formed with a discharge opening for any electrolytic bath present in said second chambers.

5. The cell defined in claim 4 wherein said inlet and outlet mouthpieces are formed with reduced-diameter passageways connecting the interior of said anode and said second chambers for supplying same with a sufficient flow of electrolytic bath to lubricate said seals for preventing scaring of the surface of said bar.

6. The cell defined in claim 1, further comprising an inner vessel disposed in said outer vessel and adapted to house said anode, and means for supplying a flow of said electrolytic bath to said inner vessel, whereby said electrolytic bath flows in said anode parallel to said bar, and transferring said electrolytic bath from said inner vessel to said outer vessel.

7. The cell defined in claim 6 wherein said inner vessel is formed as a cylinder centered on a horizontal axis coaxial with said anode, said inner vessel being formed with a return opening at the top thereof for transferring said electrolytic bath from said inner vessel to said outer vessel by the overflow of said electrolytic bath through said return opening.

8. The cell defined in claim 14 wherein said inlet and outlet mouthpieces are connected to, and sealed with, said tubular anode extending the length of said outer vessel and suspended above said electrolytic bath contained permanently therein, a return opening being formed in a central portion of said anode at the top thereof, whereby said electrolytic bath supplied to said anode through said inlet and outlet mouthpieces can be transferred from said anode to said outer vessel by the overflow of said electrolytic bath through said return opening.

9. The cell defined in claim 7 wherein said means for supplying said electrolytic bath to said inner vessel and transferring same therefrom to said outer vessel includes a delivery tube supplying said electrolytic bath to said anode in a flow parallel to said bar, said anode having oppositely directed free ends spaced from said inlet and outlet mouthpieces for the flow of said electrolytic bath into said inner vessel and to provide said zone of controlled chemical attack.

10. The cell defined in claim 6 wherein said means for supplying a flow of said electrolytic bath to said inner vessel and transferring same to said outer vessel includes a delivery tube for supplying said electrolytic bath to said inner vessel and forming a head of said electrolytic bath therein, a respective anode extending from said inlet and outlet mouthpieces toward one another, each anode having a respective free end opening at said delivery tube for the flow of said electrolytic bath parallel to said bar in each anode, a respective outlet tube extending from said inlet and outlet mouthpieces into said outer vessel, each outlet tube communicating with a respective anode, and a respective orifice formed in an upper portion of said inlet and outlet mouthpieces for discharging gases evolved therein.

11. The cell defined in claim 1 wherein said outer vessel has an upper chamber forming a sealed junction therewith and provided with a vapor-drawing duct connected to an apparatus for extracting a condensate from said vapor and recycling same to said outer vessel.

12. The cell defined in claim 1 wherein said outer vessel and said upper chamber are formed with a metal outer wall having a synthetic resin lining resistant to chemical agents present in said electrolytic bath, said outer vessel being free of orifices and outlets which can form junctions or welds in the lining, the level of said electrolytic bath in said outer vessel being kept below said sealed junction formed between said outer vessel and said upper chamber.

* * * * *